US005081776A

United States Patent [19]

Stone et al.

[11] Patent Number: 5,081,776

[45] Date of Patent: Jan. 21, 1992

[54] GREETING CARD STRUCTURE

[76] Inventors: Irving I. Stone, 27500 Cedar Rd., Beachwood, Ohio 44122; Glenn T. Imhoff, 9829 Lake Ave. #206, Cleveland, Ohio 44102

[21] Appl. No.: 558,251

[22] Filed: Jul. 24, 1990

[51] Int. Cl.[5] ..... G09F 1/00

[52] U.S. Cl. ..... 40/124.1; 40/152.1; 40/155

[58] Field of Search ..... 40/124.1, 152, 156, 40/157, 152.1, 155

[56] References Cited

U.S. PATENT DOCUMENTS

| | | | |
|---|---|---|---|
| 2,292,924 | 8/1942 | Bourke | 40/124.1 |
| 2,336,867 | 12/1943 | Huber | 40/124.1 |
| 2,547,359 | 4/1951 | Bacharach | 40/152 |
| 2,649,799 | 8/1953 | Spertus | 40/152 |
| 2,958,490 | 11/1960 | Johnson | 248/34 |
| 3,161,975 | 12/1964 | McMillan | 40/152 |
| 3,200,527 | 8/1965 | Clark | 40/152 |
| 3,269,043 | 8/1966 | Swanson | 40/152.1 X |
| 3,286,382 | 11/1966 | Newman | 40/156 |
| 3,589,049 | 6/1971 | Cornelius | 40/152 |
| 3,599,361 | 8/1971 | Bowman | 40/156 |
| 3,798,806 | 3/1974 | Sanford | 40/455 |
| 3,813,799 | 6/1974 | Caravello | 40/152 |
| 4,432,152 | 2/1984 | Daenan | 40/152.1 |
| 4,610,417 | 9/1986 | Kuss | 248/460 |
| 4,711,046 | 12/1987 | Herrgord | 40/124.1 |
| 4,779,366 | 10/1988 | Jost | 40/653 |
| 4,802,294 | 2/1989 | Baus | 40/155 |
| 4,890,402 | 1/1990 | Carroll | 40/124.1 |

FOREIGN PATENT DOCUMENTS

| | | | |
|---|---|---|---|
| 2468174 | 5/1981 | France | 40/155 |

*Primary Examiner*—Kenneth J. Dorner
*Assistant Examiner*—Milton Nelson, Jr.

[57] ABSTRACT

A new greeting card structure, in which framed artwork is displayed on the greeting card, and the greeting card can be transformed into structure enabling the framed artwork to be efficaciously and attractively hung from a wall. The greeting card preferably comprises a pair of relatively rigid panels interconnected by a flexible sheet. The framed artwork is secured to one of the panels. The flexible sheet forms an integral hinge which enables the panels to pivot between open and closed positions. Also, the flexible sheet is adapted to carry a social expression message which can be read when the card is in an open position. When the greeting card is in a partially open position, the relatively rigid panels enable the greeting card to be supported, on edge, from a surface. When the greeting card is in a closed position, the panels cooperate to form mounting structure which enables the framed artwork to be effectively and attractively hung from a wall.

12 Claims, 5 Drawing Sheets

GREETING CARD STRUCTURE

TECHNICAL FIELD

The present invention relates to a greeting card in which framed artwork forms an outer decorative cover for the greeting card, and the greeting card can be transformed into structure enabling the framed artwork to be attractively and efficaciously hung from a wall.

BACKGROUND

A well known greeting card structure comprises a blank of sheet material folded along a score line into a pair of panels. The outside of one panel generally has a decoration forming part of the social expression message of the card. The inside surface of either or both of the panels is adapted to display an additional part of the social expression message of the card when the card is opened. The social expression message may be imprinted or selectively written on either panel. The panels are generally formed of a paper sheet stock which is stiff enough to self-support the greeting card when placed on a surface, on edge, in a partially open position.

In the greeting card industry, there is a continuing interest in greeting card structures which offer buyers new and attractive vehicles for conveying social expression messages.

SUMMARY OF THE INVENTION

The present invention provides a greeting card with framed artwork forming an outer decorative cover for the greeting card, and the capability of transforming the greeting card into structure enabling the framed artwork to be attractively and efficaciously hung from a wall. In using framed artwork as the outer decorative cover, the present invention is believed to provide a wholly new concept in a greeting card structure. Moreover, since the greeting card structure is transformable into structure by which the framed artwork can be hung from a wall, the product offers separate enhanced value for the framed artwork apart from its comprisal in a greeting card.

According to the preferred embodiment, the greeting card includes a pair of relatively rigid panels and a relatively flexible sheet connected to the panels. The flexible sheet includes a score line forming a hinge which allows the panels to be pivoted relative to each other between open and closed positions. The flexible sheet has a social expression message imprinted thereon. The social expression message is visible when the panels are pivoted to an open position. The framed artwork is connected to one panel and forms an outer decorative cover for the greeting card. The framed artwork preferably includes a hand painted piece of artwork, which forms part of the social expression message of the greeting card.

The structure of the greeting card enables it to be closed for delivery in a sending situation. The greeting card can be opened, by pivoting the rigid panels about the hinge formed by the flexible sheet. When the greeting card is opened, the social expression message on the inside of the board is visible in the same way that it is with a conventional greeting card. Also, when the greeting card is opened to a certain extent, the relatively rigid panels enable the greeting card to be supported, on edge on a horizontal surface, in the same way that a conventional greeting card can be supported. When the greeting card is closed, a mounting structure formed by the panels enables the framed artwork to be efficaciously and attractively hung from a wall mounting, thus transforming the greeting card into a wall hung piece of artwork.

The mounting structure comprises a connecting device extending away from one panel and a notch formed in the edge of the other panel. When the panels are in a closed position, the panels are disposed in juxtaposed relation to each other, and are located behind the framed artwork. The connecting member in the one panel extends at least partially through the notch in the other panel. The connecting member is adapted to engage a wall mounting, to enable the framed artwork to be hung (suspended) from the wall mounting. When the framed artwork is hung from the wall mounting, the panels are disposed behind the framed artwork. The framed artwork is hung from the wall mounting in a manner which effectively hides the panels. Such mounting structure enables the framed article to be efficaciously and attractively hung from a wall mounting.

The framed artwork preferably comprises a rigid frame and a canvas with the artwork painted thereon. The frame has a central window with a peripheral recess in the back side thereof. The canvas is connected to the recess in the backside of the frame, to connect the canvas with the frame. When the canvas is connected with the frame, the artwork on the canvas is visible through a window from the front of the frame.

Further features and advantages of the present invention will become apparent from the following detailed description and the accompanying drawings.

DETAILED DESCRIPTION OF THE PREFERRED EMBODIMENT

Figure 1:
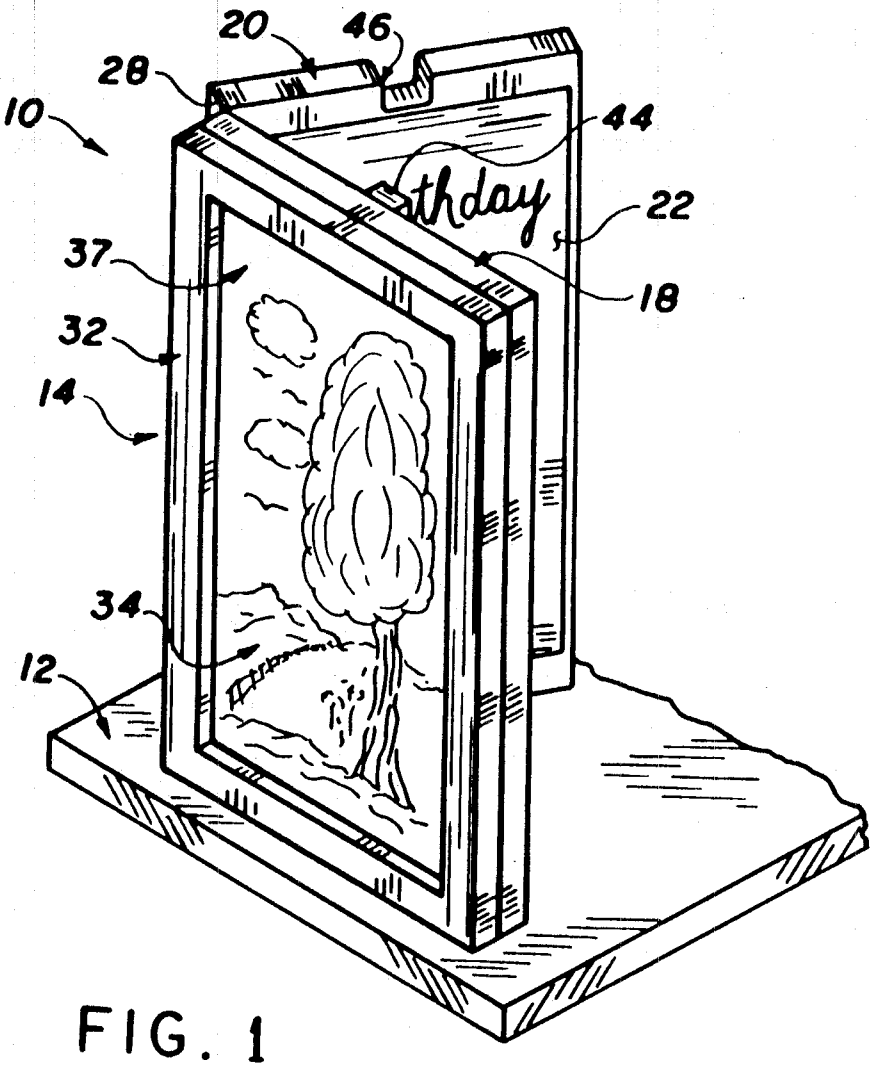
FIG. 1 is a perspective view of a greeting card constructed according to the present invention in a partially opened position, and supported on edge on a surface.
Figure 3:
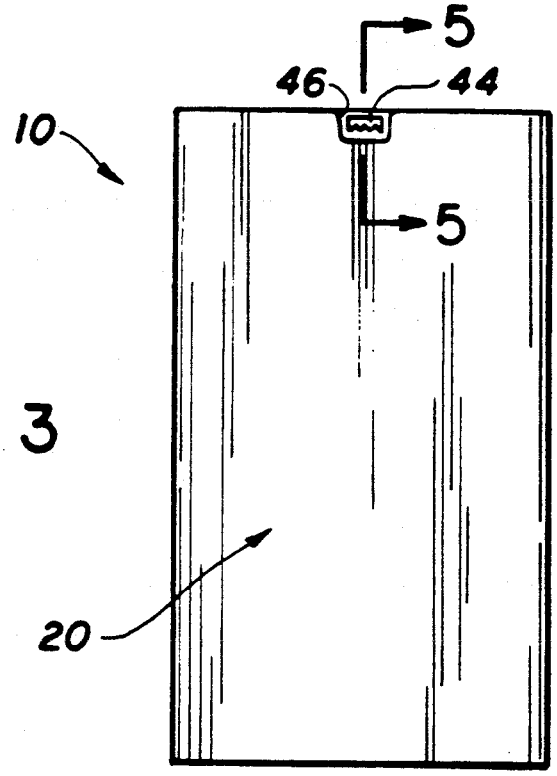
FIG. 3 is a rear elevational view of a closed greeting card according to the invention, in a closed position.

As described above, the present invention relates to a greeting card with framed artwork forming an outer decorative cover of the greeting card. In FIG. 1, a greeting card 10 is supported on a surface 12, on edge, in a partially opened position. A piece of framed artwork 14 forms an outer decorative cover for the greeting card 10. Moreover, the greeting card 10 can be folded into a closed position, and efficaciously and attractively hung (suspended) from a wall 16 (see FIG. 6).

The greeting card 10 basically comprises a pair of relatively rigid panels 18, 20, the piece of framed artwork 14, and a flexible sheet of material 22. The flexible sheet 22 is secured (e.g., by a suitable adhesive) to respective surfaces on one side of each of the panels 18, 20. The framed artwork 14 is secured to the other surface of the panel 18. The panel 18 forms the front panel of the greeting card 10.

The panels 18, 20 are substantially similar in shape, and each panel is formed from relatively rigid paperboard. In this application, "relatively rigid" paperboard means paperboard or a similar material which is relatively stiff and which is strong enough that when partially opened and in an "on edge" orientation, is capable of stably supporting the framed artwork 14 without buckling. According to the preferred embodiment, each panel 18, 20 is rectangular, but it is within the scope of this invention to provide panels having other configurations, e.g., square, triangular, hexagonal, octagonal, etc.

The flexible sheet 22 is applied to the inner surfaces 18A, 20A of the panels 18, 20 and is adhesively secured thereto. The flexible sheet 22 is preferably made of a cellulose based material (e.g., paper stock), but it is contemplated that the flexible sheet 22 may be formed of other flexible materials (e.g., synthetic plastics). An inner surface 24 of the flexible sheet 22 preferably contains a social expression message imprinted thereon. The rectangular panels 18, 20 have adjacent edges 26, 28, respectively, and the flexible sheet 22 has a score line 30 extending between and parallel to the edges 26, 28 of the rectangular panels 18, 20.

Figure 2:
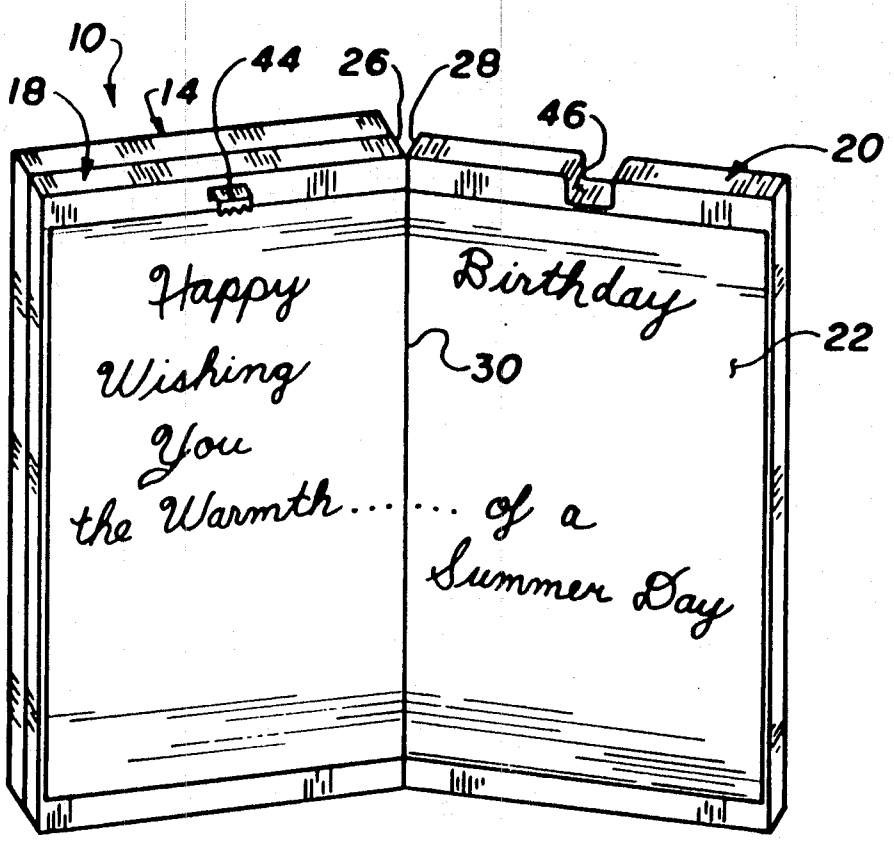
FIG. 2 is a perspective view of a greeting card according to the invention, in a fully open position.
Figure 4:
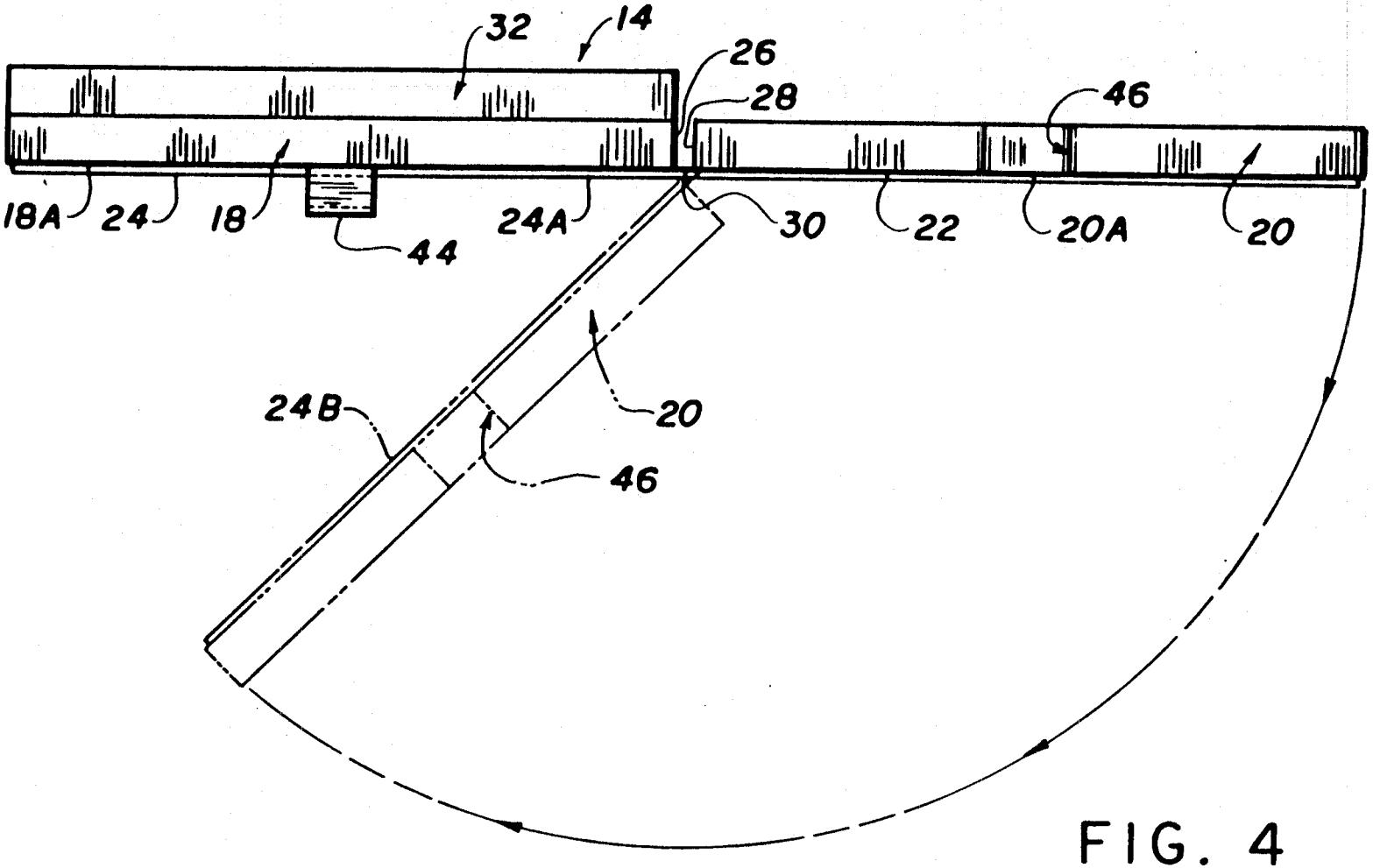
FIG. 4 is a schematic view of a greeting card of the invention, taken from the top of the greeting card, with the greeting card shown in full lines in an open position, and illustrating in phantom the manner in which the greeting is pivoted between its open and closed positions.
Figure 6:
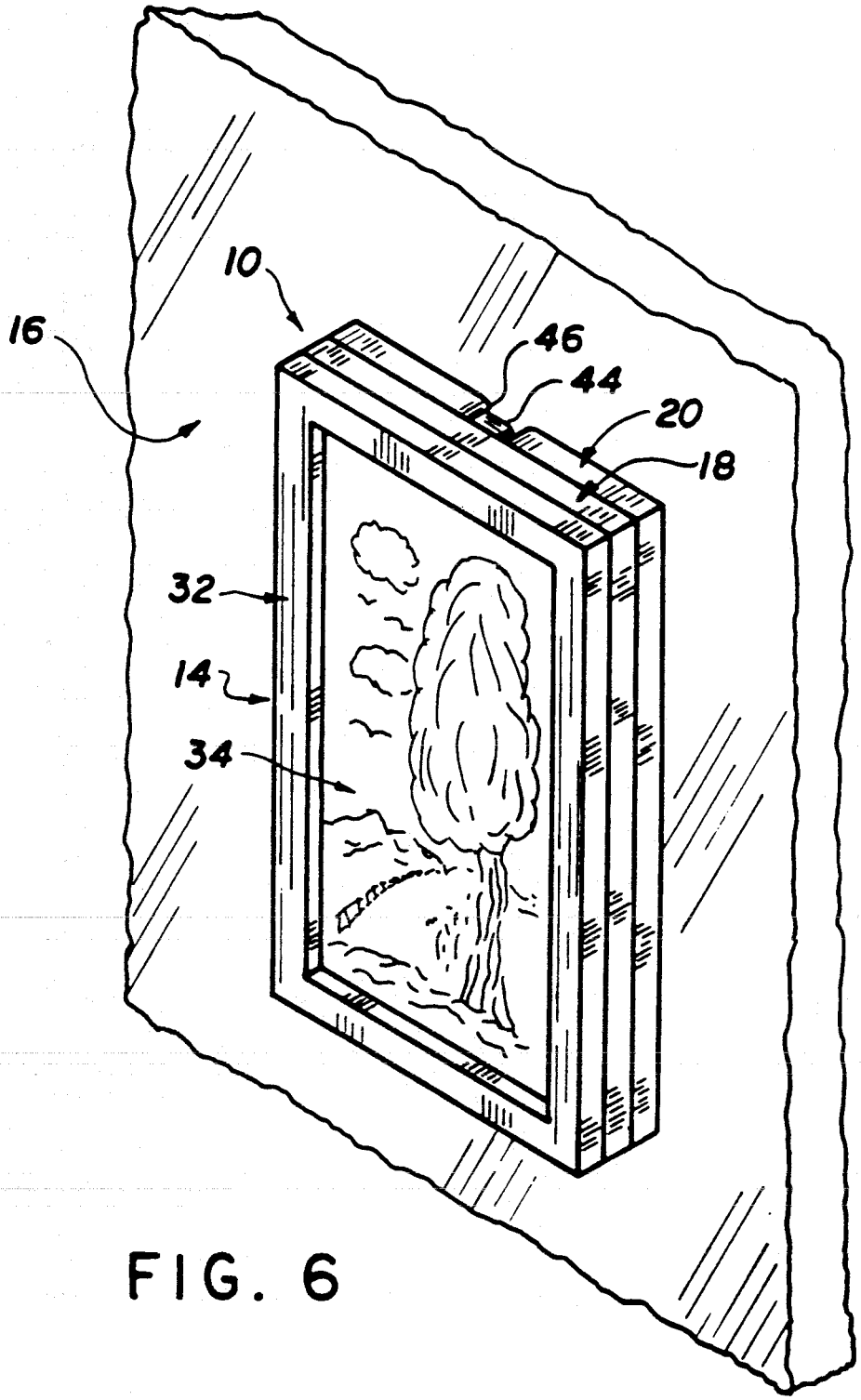
FIG. 6 is a schematic illustration of a greeting card according to the invention, in a closed position and supported from a wall.
Figure 7:
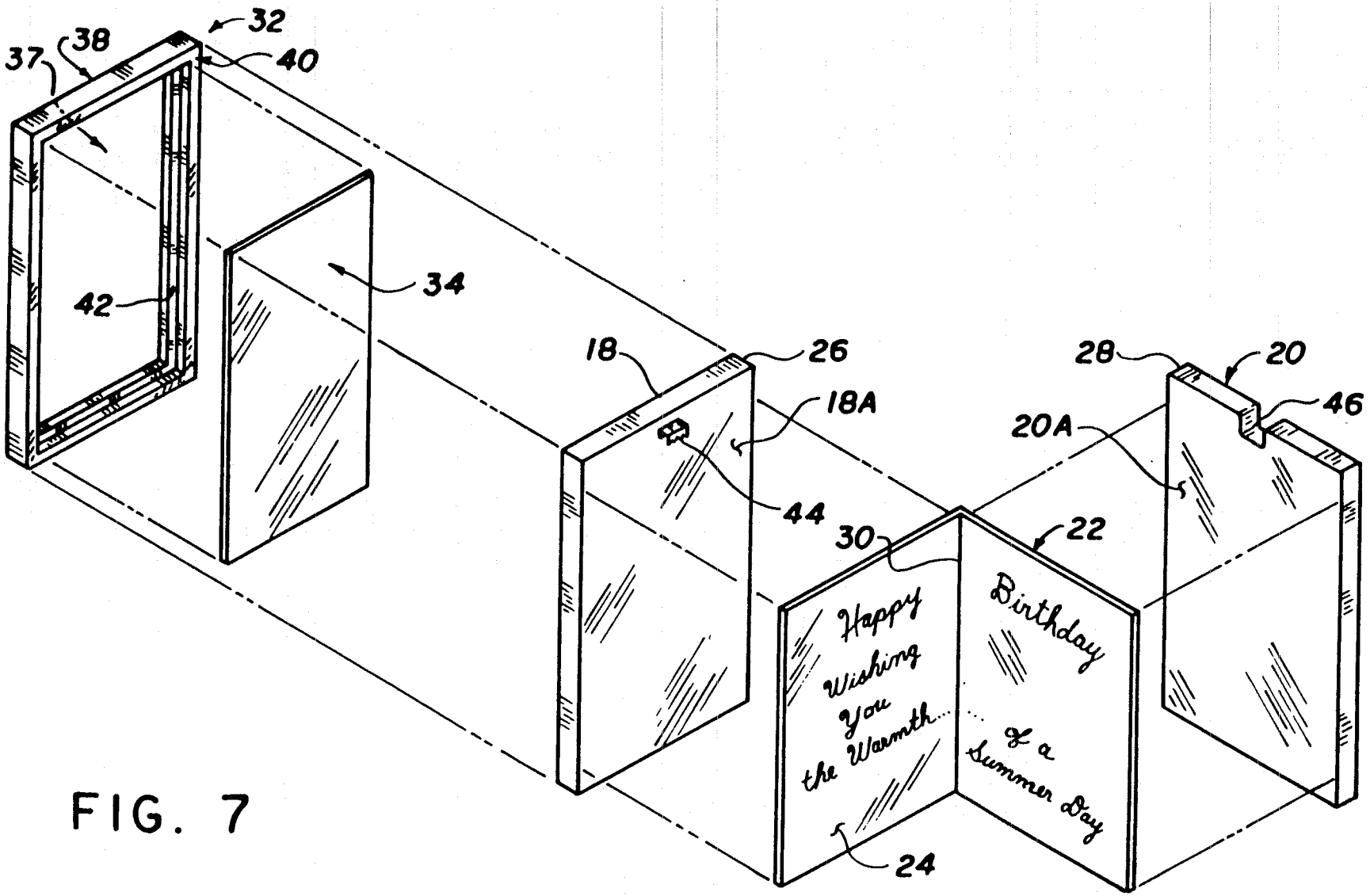
FIG. 7 is an exploded view of a greeting card structure according to the invention.

The score line 30 forms a hinge which allows the rectangular panels 18, 20 to be folded (i.e., pivoted) relative to each other between the open or partially open positions (FIGS. 1, 2) and the closed position (FIG. 6). FIG. 4 schematically illustrates the manner in which the panels are pivoted between such positions. In the closed position the panels are in overlying, substantially aligned and flat relationship. While the pivotal connection is preferably formed by the score line 30 when the flexible sheet is made of paper stock, other types of pivotal connections may be useful when the flexible sheet is made of other materials. For example, if the sheet 22 were made of plastic, the sheet could include a living hinge to enable the panels to be folded relative to each other. Also, it is possible to form the pivotal connection by means of hinge structures connected with the panels 18, 20.

The framed artwork 14 comprises a conventional picture frame 32 and a canvas 34. The canvas 34 preferably comprises canvas board, and has the artwork thereon. Preferably, the artwork is hand painted on the canvas 34. The frame 32 has a central window 37.

The picture frame 32 has an outer side 38 and an inner side 40. The inner side 40 has a peripheral recess 42 therein. The recess 42 is adapted to receive border portions of the canvas 34. The border portions of the canvas 34 are located in the recess 42 and secured to the picture frame 32 by conventional means, such as adhesive or staples. The surface of the canvas 34 having the artwork thereon is adapted to be visible through the window 37, when viewed from the outer side 38 of the frame 32. The inner side 40 of the frame 32, with the canvas 34 connected therewith, is adapted to be secured to the panel 18 by adhesive or similar means.

The panels 18, 20 are adapted to be folded (pivoted) about the score line 30 between the open, partially open, and the closed positions. In the open and partially open positions (see FIGS. 1, 2), the social expression message on the inner surface 24 of the sheet 22 is visible. In the closed position, the inner surface 24 of the greeting card, which carries the social expression message, is folded over into facing, juxtaposed portions 24A, 24B (see FIG. 5).

The greeting card 10 can be supported, on edge, on the surface 12 by placing the card in a partially open position, with panels 18, 20 disposed at an angle to each other (see FIG. 1). When the greeting card 10 is in the partially opened position, the framed artwork 14 forms a decorative cover for the greeting card, and the social expression message on the inside of the sheet 22 is at least partially visible (see e.g., FIG. 1).

The greeting card 10 may be selectively converted (transformed) into a mounting structure for hanging the framed artwork 14 from a wall 16. Specifically, when the panels 18, 20 are pivoted to a closed position, the panels are (i) aligned with each other, (ii) disposed behind the framed artwork 14, and (iii) adapted to form mounting structure for hanging the framed artwork 14 from a wall mounting. A connecting member 44 is secured to the panel 18 directly or through the surface of sheet 22 that overlies panel 18. The connecting member 44 extends away from the panel 18, and comprises any conventional type of structure for connecting a framed piece of artwork to a wall mounting. A corresponding notch 46 is formed (preferably die cut) in the top edge portion of the panel 20. The notch 46 extends through the panel 20, and through any respective portion of sheet 22 covering the edge of the panel 20. When the greeting card 10 is folded into the closed position, the connecting member 44 extends partially or completely through the notch 46.

Figure 5:
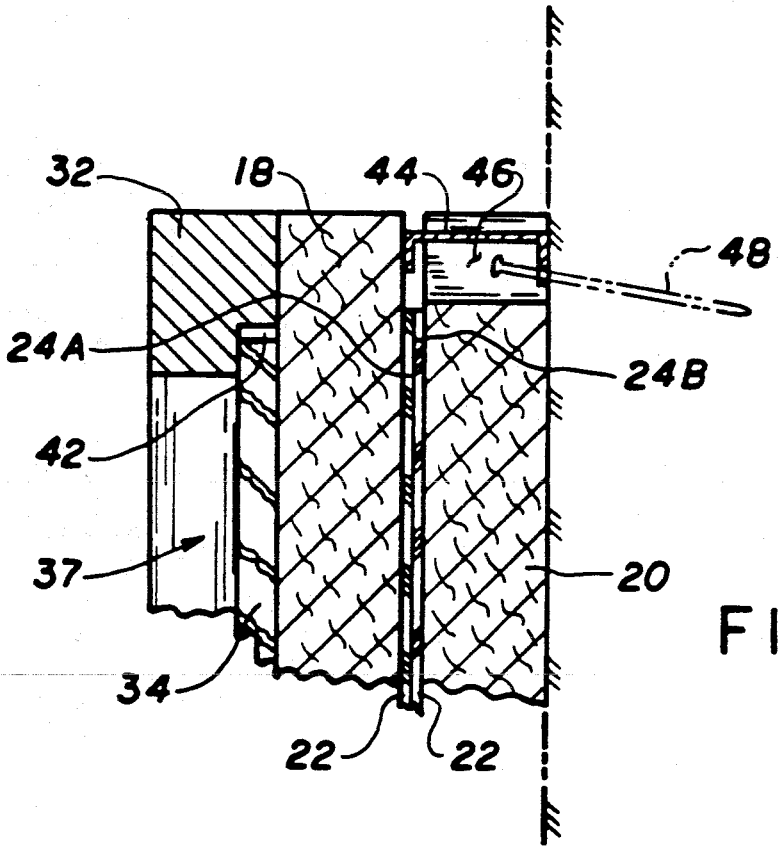
FIG. 5 is a sectional view of the greeting card of FIG. 3, .long the line 5—5.

As shown in FIG. 5, when the greeting card 10 is in its closed position, the connecting member 44 extends a sufficient distance outwardly from the panel 18 so that the distal end of the connecting member 44 can effectively engage a nail 48 or other conventional wall mounting to enable the framed artwork 14 to be hung from the wall mounting. When connecting member 44 is engaged with the wall mounting 48, it holds the panels 18, 20 closely against each other, and resists any tendency for the panels to pivot toward an open position. Also, since the panels 18, 20 are aligned with each other and located behind the framed artwork 14, the panels 18, 20 are essentially covered by the framed artwork 14 when the framed artwork is hung from a wall. Those features enable the framed artwork 14 to be efficaciously and attractively hung from a wall when the greeting card is closed.

The present invention thus provides a greeting card structure with framed artwork forming a decorative cover, and designed to be transformed into a structure for efficaciously and attractively hanging the framed artwork from a wall. The connecting member 44 preferably does not extend beyond panel 20 when the greeting card 10 is in its closed position, thereby enabling the greeting card to be laid flush on a horizontal support surface or to be efficiently packaged for delivery.

The principles, preferred embodiment and modes of operation of the present invention have been described in the foregoing specification. The invention which is intended to be protected herein should not, however, be construed as limited to the particular form described as it is regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention set forth in the appended claims.

What is claimed is:

1. A greeting card structure, comprising:

a pair of relatively rigid panels pivotal between open and closed positions;

each of said pair of panels having a respective inner surface and a respective outer surface;

a flexible sheet connected to and substantially covering the inner surfaces of each of said pair of panels, said flexible sheet having a portion extending between said pair of panels and forming a hinge for enabling said pair of relatively rigid panels to pivot relative to each other between said open and said closed positions;

said flexible sheet having an inner surface adapted to carry a social expression message which is displayed when said pair of panels are in said open position;

said pair of panels when in a partially open position being adapted to rest on edge on a surface to support said greeting card in a partially open position on the surface;

framed artwork connected with one of said pair of panels, said framed artwork comprising a painting supported by the outer surface of said one of said pair of panels and a frame extending about a border of said painting and connected with said one of said pair of panels, said frame extending away from the outer surface of said one of said pair of panels and the painting supported thereon in a direction transverse to the outer surface of said one of said pair of panels, said frame forming a central window through which said painting can be viewed; and said pair of panels when in said closed position forming a wall support structure extending away from said inner surface of said one of said pair of panels, said wall support structure adapted to enable said framed artwork to be suspended from a wall when said pair of panels are in said closed position.

2. A greeting card structure as defined in claim 1 wherein each panel comprises a substantially rectangular section of paperboard, and said flexible sheet comprises cellulose based sheet stock.

3. A greeting card structure as defined in claim 1, wherein said framed artwork comprises a relatively rigid piece of canvas board with the painting thereon.

4. A greeting card structure as defined in claim 3 wherein said artwork is painted onto said canvas.

5. A greeting card structure as defined in claim 4 wherein said sheet has a social expression message imprinted thereon.

6. A greeting card structure as defined in claim 1, wherein said pair of panels when in said closed position are aligned with each other in superposed registry and the portions of said flexible sheet covering the inner surfaces of each of said pair of panels are disposed between said pair of panels in juxtaposed relationship to each other.

7. A greeting card structure as defined in claim 6 wherein said wall support structure comprises a connecting member extending away from the inner surface of said one of said pair of panels and a recess in the other of said pair of panels, said connecting member and said recess being aligned with each other and said connecting member extending at least partially through said recess when said pair of panels are in said closed position, said connecting member being adapted to engage a wall mounting when said pair of panels are in said closed position, and said connecting member when engaged with a wall mounting being adapted to suspend said greeting card structure from a wall and to maintain said pair of panels in said closed position.

8. A greeting card structure as defined in claim 7 wherein each of said panels has a rectangular configuration, said connecting member extending away from said inner surface of said one panel, and said recess formed in an edge of said other of said panels.

9. A greeting card structure as defined in claim 6, wherein said framed artwork comprises a relatively rigid piece of canvas board with the painting thereon.

10. A greeting card structure as defined in claim 9, wherein said frame has an inner side disposed substantially against the outer surface of said one of said panels and an outer side forming an exterior portion of said greeting card structure, said piece of canvas board having a peripheral border and said inner side of said frame having a peripheral recess which receives said peripheral border of said piece of canvas board.

11. A greeting card structure as defined in claim 9 wherein said painting is painted onto said canvas.

12. A greeting card structure as defined in claim 8 wherein said sheet has a social expression message imprinted thereon.

* * * * *